United States Patent [19]

Strecker

[11] Patent Number: 4,609,500

[45] Date of Patent: Sep. 2, 1986

[54] REFINING OF OIL AND PRODUCT THEREOF

[75] Inventor: Leopold R. Strecker, Union, N.J.

[73] Assignee: CPC International Inc., Englewood Cliffs, N.J.

[21] Appl. No.: 470,120

[22] Filed: Feb. 28, 1983

Related U.S. Application Data

[63] Continuation-in-part of Ser. No. 311,571, Oct. 15, 1981, abandoned.

[51] Int. Cl.[4] ..... C11B 3/08

[52] U.S. Cl. ..... 260/423; 260/424

[58] Field of Search ..... 260/423, 424, 428, 428.5

[56] References Cited

U.S. PATENT DOCUMENTS

| | | | |
|---|---|---|---|
| 1,744,843 | 1/1930 | Taylor et al. | 260/423 |
| 1,973,790 | 9/1934 | Appleton | 87/12 |
| 2,441,923 | 5/1948 | Sullivan | 89/118 |
| 2,510,379 | 6/1950 | Christenson | 260/425 |
| 2,587,954 | 2/1951 | Babayan | 260/424 |
| 2,903,434 | 9/1959 | Gloss et al. | 252/441 |
| 2,981,697 | 4/1961 | Mickelson et al. | 252/450 |
| 3,284,213 | 11/1966 | Van Akkeren | 99/118 |
| 3,354,188 | 11/1967 | Boch et al. | 260/424 |
| 3,590,059 | 6/1971 | Velan | 260/423 |
| 3,895,042 | 7/1975 | Taylor | 260/424 |
| 4,089,880 | 5/1978 | Sullivan | 260/424 |
| 4,113,752 | 9/1978 | Watanabe et al. | 260/424 |
| 4,162,260 | 7/1979 | Segers | 260/424 |
| 4,272,447 | 6/1981 | Beharry | 260/425 |

FOREIGN PATENT DOCUMENTS

| | | |
|---|---|---|
| 330967 | 1/1933 | Canada . |
| 485640 | 8/1952 | Canada . |
| 549734 | 12/1957 | Canada . |
| 589161 | 12/1959 | Canada . |
| 664968 | 6/1963 | Canada . |
| 871735 | 5/1971 | Canada . |
| 1003435 | 1/1977 | Canada . |
| 1060041 | 8/1979 | Canada . |
| 1269904 | 4/1972 | United Kingdom . |
| 1359186 | 7/1974 | United Kingdom . |
| 1491170 | 11/1977 | United Kingdom . |
| 1510056 | 5/1978 | United Kingdom . |
| 2058121 | 4/1981 | United Kingdom . |

OTHER PUBLICATIONS

Some Problems Involved in the Water Wash of Neutralized Vegetable Oils by Braae, Brimberg and Nyman, The Journal of the American Oil Chemist's Society, vol. 34, pp. 293–299, Feb. 2, 1956.

Clay–Heat Refining of Edible Oils, by T. K. Mag, Symposium: Processing of Edible Oils, AOCS Meeting, Ottawa, Sep. 1972.

*Primary Examiner*—Anton H. Sutto

[57] ABSTRACT

The present invention provides a refined edible oil which has good oxidative, flavor and cold-test stabilities, and which will retain such characteristics in storage without the necessity for stabilizing additives. In addition, the present invention provides a method for the production of such a refined oil which is characterized both by its ability to refine oils with impurities which had previously prevented acceptable processing by physical refining methods and further by its ability to recover economically valuable impurities and by-products.

12 Claims, No Drawings

REFINING OF OIL AND PRODUCT THEREOF

This is a continuation-in-part of Application Ser. No. 311,571 filed Oct. 15, 1981, now abandoned.

SUMMARY OF THE INVENTION

The present invention relates to the refining of crude vegetable oils. In particular, the present invention relates to the refining of such crude oils containing impurities to produce an essentially additive free product having good oxidative, flavor and cold-test stabilities.

BACKGROUND OF THE INVENTION

In the past, edible fats and oils derived from animal sources were refined for use by physical refining methods. Vegetable oils however could not be satisfactorily refined by these methods. The many and varied impurities vegetable oils might contain would cause undesirable characteristics, such as dark colors or off-flavors or the like, in the finished oils.

At present, the most common method of refining vegetable oils is the treatment of crude oils with an alkali. Alkali refining removes free fatty acids and other acidic materials, some phosphatides, proteinaceous matter, pigments and trace metals. Until recently, most oils could not be deodorized satisfactorily unless they had been alkali refined. However, although alkali refining is suitable for preparation of oils for further processing steps, such as bleaching and deodorization, it has some serious disadvantages also.

Alkali refining typically results in a high loss of the neutral oil components of the crude oil, reducing the amount of yield of the refined oil product. In addition, the removal of free fatty acids by alkali refining results in the production of soapstock which has to be further processed in order to recover the fatty acids as a by-product. Further, alkali refining typically results in a large amount of waste water, often causing a serious water pollution problem. Alkali refined oils are additionally disadvantageous in that the finished oils require stabilizers, typically antioxidants or citric acid, or the like, to maintain acceptable flavor characteristics and prevent harmful oxidation on storage.

Alkali refining also involves a dewaxing step which increases the cost of the refined oil. This additional step removes such low temperature insoluble compounds, which are generally referred to as waxes although these compounds are not limited to compounds which are classed as waxes in a strict chemical sense. Without this processing step of chilling the oil and removing the solids formed, the finished oil would not have acceptable cold-test stability, i.e. it would not retain good clarity during storage at 0° C. for 24 hours.

Various processes for the physical refining of vegetable oils have been proposed over the last few decades. Some of these have been successful with certain crude oils containing limited amounts and types of impurities. For example, U.S. Pat. No. 1,744,843 to Taylor, et al, relates to the process of bleaching animal and vegetable oils and fats and comprises adding bleaching earth and sulfuric acid. The bleaching earth is added at least as early in the process as the acid so that the fat or oil is exposed to the acid only in the presence of the bleaching earth. The mixture is agitated and the supernatant oil is drawn off and filtered through a layer of diatomaceous earth.

U.S. Pat. No. 1,964,875 to Freiberg relates to an alkali-refining process, and discloses a method of removing impurities from oils and fats in which the oils or fats are mixed with a small quantity of concentrated phosphoric acid. The mixture is then heated slowly to about 70° C. and stirred, and a small quantity of cellulose is added. When the action of the phosphoric acid and the cellulose is complete, the oil is separated by filtration.

U.S. Pat. No. 1,973,790 to Appleton relates to the method of purifying non-edible vegetable oils to increase their heat stability for use in paints. The oil is purified by thoroughly mixing it with an amount of phosphoric acid which is sufficient to react with the impurities in the oil. This will cause such impurities to be precipitated and settle out of the oil in the form of a sludge. The purified oil is then segregated from the sludge.

U.S. Pat. No. 2,441,923 to Sullivan, although itself not relating to physical refining, does disclose that acid-activated adsorptive material such as Fuller's earth can be used to remove residual color from alkali refined oil.

U.S. Pat. No. 2,510,379 to Christenson relates to a method of removing lecithin, other phosphatides and coloring matter. After the treatment of the oil with an alkali, the oil is further treated with an equivalent amount of a strong acid, and resultant salt produced by the alkali and the acid is removed. Phosphoric acid and other strong acids are used to neutralize the oil (column 2 lines 35–42). The reference also shows the use of acid activated bleaching clay (column 4, lines 10–15).

U.S. Pat. No. 2,587,254 to Babayan relates to a method for reclaiming contaminated refuse palm oil used in steel fabrication. According to this method the refuse palm oil is treated with from 1% to 5% (by weight) of either phosphoric acid, sulfuric acid or hydrochloric acid in at least 50% water (by weight of oil) at some temperature from 0° C. to 100° C. The mixture is allowed to stratify and the oil layer is separated from the aqueous layer and bleached.

U.S. Pat. No. 2,903,434 to Gloss et al relates not to the refining of oils, but to the preparation of activated bleaching clay. Montmorillonite clay is treated with an aqueous solution of a fluorine compound and either hydrochloric, phosphoric or sulfuric acid.

U.S. Pat. No. 2,981,697 to Mickelson et al shows a process for the preparation of an acid-activated decolorizing clay. An acid-activatable subbentonite clay is treated with hydrogen chloride in aqueous solution and then washed with water until substantially free of chlorides. Then the washed clay is treated with either sulfuric acid or phosphoric acid at a temperature below about 50° C. to remove the residual chlorides. Excess acid is removed from the clay, and the clay is flash-dryed at temperatures below 100° C.

U.S. Pat. No. 3,284,213 to Van Akkeren discloses a process for treating triglyceride cooking oils to inhibit breakdown during heating and to prevent foaming. About 0.05 to 3.5% of concentrated phosphoric acid is added to the oil, and the oil is heated slowly to a temperature of about 100° C. and stirred slowly to prevent the formation of free acid in the oil. Bleaching clay is added to the oil when the temperature has reached about 100° C. and the mixture is then heated to about 120° C. for about 15–30 minutes. The oil is first cooled and filtered to remove the clay and phosphoric acid material, and then heated to about 220°–225° C. under reduced pressure. The reference teaches that it is important to remove all of the phosphoric acid with the bleaching clay prior to the final heat treatment. A ratio of phosphoric acid to clay of 1:2 can be calculated from the examples.

U.S. Pat. No. 3,354,188 to Rock et al shows a method of refining oil in which a refining agent substantially insoluble in the oil is first combined with an emulsifying agent, and then mixed with the oil to form an emulsion. A particulate solid, such as Fuller's earth, activated clay or charcoal is then added to adsorb the refining agent and the oil is separated from the solid. Phosphoric acid is listed among the refining agents.

U.S. Pat. No. 3,590,059 to Velan discloses a process for the purification of vegetable and animal oils containing fatty acids and other impurities. The crude or degummed oil is first washed with about 1 to 5% by weight of water and the aqueous phase is separated from the resultant mixture. The washed oil is then treated with less than 0.3% by weight of organic acid, such as formic, acetic, oxalic, lactic, citric, tartaric or succinic acids or the anhydrides of any of these acids or mixtures of these acids. The moisture level of the oil is adjusted and the oil is bleached with a bleaching earth. Following this, the bleached oil is steam distilled under vacuum to remove fatty acids. The use of mineral acids, rather than organic acids, is also suggested.

Great Britain Patent No. 1,359,186 and U.S. Pat. No. 4,113,752 to Watanabe et al discloses a method of refining palm-type oils. Essentially, 0.01 to 2.0% by weight of phosphoric acid is added to the crude palm-type oil, which is substantially phosphatide-free and in which any carotinoids remain substantially in a heat sensitive condition. After mixing, activated clay is added and the temperature is increased to and maintained at about 100° C. for about 5 to 30 minutes. Then the clay is separated from the oil and the oil is refined-deodorized by steam distillation at a temperature of 200°–270° C. with superheated steam. The calculated ratio of phosphoric acid to bleaching clay ranges from about 1:5 to 1:60.

U.S. Pat. No. 3,895,042 to Taylor relates to a process for refining crude vegetable oils as well as other fatty substances. The crude fatty substances are heated to a temperature of from about 325° F. to 500° F. under vacuum or inert atmosphere in the presence of phosphoric acid and acid activated clay. The resulting product is then filtered.

OBJECTS OF THE PRESENT INVENTION

It is an object of the present invention to provide a process for the refining of crude vegetable oils.

It is a further object of the present invention to provide a process for the refining of crude vegetable oils containing such impurities as phospholipids, waxes and trace metals.

It is a still further object of the present invention to provide a process for the refining of crude vegetable oils in which the economically valuable by-products may be more easily recovered.

It is another object of the present invention to provide a refined oil product having increased stability of flavor characteristics.

It is another object of the present invention to provide a refined oil product having increased stability against oxidation.

It is another object of the present invention to provide a refined oil product having satisfactory cold-test stability without the necessity for a separate winterizing step.

The objects features and advantages of the present invention will become more apparent in light of the following detailed description of the preferred embodiment thereof.

According to the present invention, there is provided a process for the refining of crude vegetable oils to provide a product having good oxidative, flavor and coldtest stabilities, comprising the steps of:

(a) degumming the crude oil by
  (i) combining such a crude oil with a small quantity of water to form a mixture,
  (ii) agitating said mixture, and
  (iii) separating the oil from the water and precipitating impurities,
(b) degumming/demetalizing the degummed oil obtained in step (a)(iii) by
  (i) combining said oil with a small amount of a suitable degumming/demetalizing reagent known to the art to form a mixture,
  (ii) agitating the mixture,
  (iii) combining the mixture with a small amount of water,
  (iv) agitating said mixture, and
  (v) separating the oil from the residual impurities,
(c) bleaching the degummed/demetalized oil obtained in step (b)(v) by
  (i) combining said oil with an amount of phosphoric acid in aqueous solution so as to form a mixture with at least two one-hundredths of a percent (0.02%) phosphoric acid by weight,
  (ii) maintaining the mixture at a suitable temperature while agitating intensely to allow reaction,
  (iii) combining the mixture thus treated in step (c)(ii) with a bleaching agent in such proportion as to allow in the final product a level of up to three parts per million (3 ppm) residual phosphorus derived from the phosphoric acid added in (c)(i),
  (iv) raising the temperature of the mixture of step (c)(iii) under vacuum to a temperature suitable for the action of the chosen bleaching agent and maintaining said temperature while agitating said mixture.
  (v) cooling the mixture of step (c)(iv) to a temperature at which the vacuum can be broken, and
  (vi) filtering the bleached oil; then
(d) steam refining-deodorizing the bleached oil obtained in step (c)(vi).

According to another embodiment of the present invention, there is provided a process for the refining of crude vegetable oils to provide a product having good oxidative, flavor and cold-test stabilities, comprising the steps of:

(a) degumming the crude oil by
  (i) combining said crude oil with a small amount of water to form a mixture with said oil,
  (ii) agitating said mixture,
  (iii) separating the oil from the water and precipitating impurities;
(b) bleaching the oil obtained in step (a)(iii) by
  (i) combining said oil with an amount of phosphoric acid in aqeuous solution so as to form a mixture with at least two one-hundredths of a percent (0.02%) phosphoric acid by weight,
  (ii) maintaining the mixture at a suitable temperature while agitating intensely to allow reaction,
  (iii) combining the mixture thus treated in step (b)(ii) with a bleaching agent in such proportion as to allow in the final product a level of up to three parts per million (3 ppm) residual phosphorus derived from the phosphoric acid added in (b)(i), (iv) raising the temperature of the mixture of step (b)(iii) under vacuum to a temperature suitable for the action of the chosen bleaching agent and maintaining said temperature while agitating said mixture.

(v) cooling the mixture of step (b)(iv) to a temperature at which the vacuum can be broken, and (vi) filtering the bleached oil; then (c) steam refining-deodorizing the bleached oil obtained in step (b)(vi).

According to still another embodiment of the present invention, there is provided a process for the refining of crude vegetable oils to provide a product having good oxidative, flavor and cold-test stabilities, comprising the steps of:

(a) degumming/demetalizing the crude oil by (i) combining said oil with a small amount of suitable degumming/demetalizing reagent known to the art to form a mixture, (ii) agitating the mixture, (iii) combining the mixture with a small amount of water, (iv) agitating the mixture, (v) separating the oil from the water and precipitating impurities;

(b) bleaching the oil obtained in step (a)(v) by (i) combining said oil with an amount of phosphoric acid in aqueous solution so as to form a mixture with at least two one-hundredths of a percent (0.02%) phosphoric acid by weight, (ii) maintaining the mixture at a suitable temperature while agitating intensely to allow reaction, (iii) combining the mixture thus treated in step (c)(ii) with a bleaching agent in such proportion as to allow in the final product a level of up to three parts per million (3 ppm) residual phosphorus derived from the phosphoric acid added in (b) (i), (iv) raising the temperature of the mixture of step (b)(iii) under vacuum to a temperature suitable for the action of the chosen bleaching agent and maintaining said temperature while agitating said mixture.

(v) cooling the mixture of step (b)(iv) to a temperature at which the vacuum can be broken, and (vi) filtering the bleached oil; then (c) steam refining-deodorizing the bleached oil obtained in step (b)(vi).

According to another embodiment of the present invention, there is provided a process for the refining of crude vegetable oils to provide a product having good oxidative, flavor and cold-test stabilities, comprising the steps of:

(a) bleaching the crude oil by (i) combining said oil with an amount of phosphoric acid in aqueous solution so as to form a mixture with at least two one-hundredths of a percent (0.02%) phosphoric acid by weight, (ii) maintaining the mixture at a suitable temperature while agitating intensely to allow reaction, (iii) combining the mixture thus treated in step (a)(ii) with a bleaching agent in such proportion as to allow in the final product a level of up to three parts per million (3 ppm) residual phosphorus derived from the phosphoric acid added in (a)(i), (iv) raising the temperature of the mixture of step (a)(iii) under vacuum to a temperature suitable for the action of the chosen bleaching agent and maintaining said temperature while agitating said mixture.

(v) cooling the mixture of step (a)(iv) to a temperature at which the vacuum can be broken, and (vi) filtering the bleached oil; then (b) steam refining-deodorizing the bleached oil obtained in step (a)(vi).

DETAILED DESCRIPTION OF THE PRESENT INVENTION

It has now been determined that an edible oil having good flavor, oxidative and cold-test stability characteristics can be obtained from a physical-type refining process. The present invention provides an oil as a final product with a level of up to three parts per million (3 ppm) residual phosphorus derived from phosphoric acid used in the process.

While the patentee does not wish to be bound to one particular mechanism, it is presently supposed that the phosphoric acid added as a processing aid reacts with minor components of the oil, such as chlorophyll, phospholipids and prooxidant metals during processing and may prevent some deleterious effect the bleaching earth would otherwise have on the oil if the phosphoric acid were not present. It is believed that the phosphorus has no further beneficial effect after the bleaching step and its removal after action of the bleaching earth would not alter the beneficial characteris-tics of the oil of the present invention. However, since the residual level of up to three parts per million (3 ppm) phosphorus obtained in this manner is substantially lower than the level often encountered in alkali-refined oils, it is believed that complete removal of the processing aid is unnecessary. A residual level of up to three parts per million (3 ppm) phosphorus in the finished oil is undetectable as phosphoric acid by normal acidity measurements and below the detectable level for phosphorus using the approved test AOCS Official Method No. Ca 12-55.

Phosphorus remaining in the bleached oil in the form of phospholipids does not produce an oil having the superior properties of the present invention. It is believed that such phosphorus compounds have no ability to bind heavy metals, such as iron and copper which promote oxidation.

To obtain a finished oil with these superior properties, the process must be carefully controlled to satisfactorily remove essentially all of the phosphoric acid without permitting the oil to be exposed to the action of the bleaching agent alone. The parameters for such a controlled removal of phosphoric acid were determined experimentally. Treatment of the oil with an excess of bleaching agent would remove all of the phosphoric acid. It is believed that this would have the same effect as treatment of the oil with bleaching agent alone, which would impair the oxidative stability of the oil. At residual phosphorus levels above three parts per million (3 ppm) some acidity becomes detectable and, although refined oils having a phosphorus level this high may have acceptable initial properties, such oils do not retain these superior properties on storage.

In the present invention, a process is shown in which an unrefined vegetable oil is first pre-treated to remove impurities, then steam-refined to produce a finished oil having good oxidative, flavor and cold-test stabilities.

Vegetable oils are known to contain many different types of impurities which must be removed prior to steam refining. Crude oils may contain any or all of the following: free fatty acids, hydratable phospholipids, non-hydratable phospholipids, low-temperature insolubles (generally referred to as "waxes"), trace metals, pigments, proteinaceous matter, mucilaginous matter, mycotoxins, pesticides and oxidation products. With the exception of cottonseed oil, which contains a dark red pigment generally referred to as "gossipol" which is considered to be removable only by treatment with alkali, the process of the present invention can be applied to any of the commercially available oils: corn, soybean, peanut, safflower, sunflower, rapeseed, rice bran, coconut, palm, palm kernel and babassu oils.

These commercially known oils contain at least some of the impurities listed above. Some, such as soybean oil and rapeseed oil, typically contain relatively high concentrations of hydratable and non-hydratable phospholipids whereas the concentration of other impurities, such as low temperature insolubles (waxes) may not present a removal problem. Other oils, such as corn oil and sunflower oil, may contain relatively high concentrations of waxes, or trace metals, whereas phospholipids may not normally present a removal problem.

Still other oils, such as palm oil, palm kernel oil or coconut oil may not have concentrations of impurities which require removal prior to bleaching and steam refining. Physical refining methods have previously been applied to such oils with some success. The present invention, however, provides for the refining of such oils with the beneficial properties which could not be obtained with consistency heretofore.

Most of the impurities referred to above do not represent useful by-products and no attempt is generally made to recover them. Free fatty acids and phospholipids can be useful, however, and it is not unusual to attempt to recover these. In an alkali refining process, the free fatty acids removed are only recoverable from the soapstock produced and are of generally low quality. In the present invention, phospholipids as removed are of better quality and can be utilized for animal feed or the like, or further processed to recover commercial quality lecithin. Free fatty acids, of a higher quality than the acid oil obtained from soapstock, can be obtained directly from the steam distillate in a much purer form.

It should be noted that the process described herein is effective to remove mycotoxins, such as aflatoxin, from the crude oil. However, where such toxins are present it is possible that by-products may contain these contaminants.

Assuming, for the moment, that a certain crude oil contained relatively high concentrations of low temperature insolubles (waxes) as well as trace metals and both hydratable and non-hydratable phospholipids, as a first processing step the crude oil would be degummed with water. A small amount of water, typically 1 to 5 percent by weight, would be added and agitated with the oil. The amount of water should be sufficient to remove the significant portion of the hydratable compounds. Afterwards the oil is separated by any practical means, and centrifuging or settling are common.

This step may be carried out at any convenient temperature and room temperature is often suitable. However, lower temperatures are useful in order to provide the most efficient removal of compounds which are not soluble in the oil at low temperatures, referred to generally as "waxes". It is advantageous therefore where such waxes are present to complete this step at a slightly lower temperature, and temperatures in the range of about 5° C. to about 20° C. are most suitable.

In order to remove non-hydratable phospholipids and trace metals such as iron, copper, calcium, magnesium or the like, an additional pretreatment step is necessary. A small amount of a suitable degumming/demetalizing reagent, typically less than one percent (1%) by weight, and water are added to the oil and agitated. The reagent may be chosen from many which are known to the art, such as organic or inorganic acids or their anhydrides. Emulsifiers and surfactants are also known to be useful for this purpose. At present, the preferred reagents are maleic, fumaric, citric and phosphoric acid. The degummed oil is then separated from the heavy phase containing any residual phospholipids and trace metals.

Oil prepared for bleaching, through the steps set out above, or by any other method known to the art, is combined with a small amount of phosphoric acid in aqueous solution. It is preferred to use a concentrated solution to reduce the need for later water removal. The amount of phosphoric acid should be enough to form a mixture with at least two one-hundredths of a percent (0.02%) phosphoric acid by weight in the oil. Although larger amounts could be used, any concentration higher than about two-tenths of a percent (0.2%) phosphoric acid would cause a removal problem and this level therefore represents an upper limit as a practical matter. The preferred range is from about five one-hundredths of a percent (0.05%) to about one tenth of a percent (0.1%) phosphoric acid by weight.

This mixture of oil and phosphoric acid is then agitated and it is advantageous to raise the temperature slightly. Temperatures between about 35° C. and 40° C. are typically employed advantageously, although at higher temperatures, usually above 40° C., it is considered necessary to introduce vacuum to prevent the harmful effects of oxidation on the oil quality.

At this stage a bleaching agent, such as activated bleaching earth, Fuller's earth or the like is added in a suitable amount in order to remove most, but not all, of the phosphoric acid previously added. The amount of bleaching agent should be calculated to provide an oil as a final product with a level of up to three parts per million (3 ppm) residual phosphorus derived from the phosphoric acid. The preferred bleaching agent is an activated bleaching clay commercially available under the Tradename Filtrol 105 TM from Filtrol Corporation, which has been used advantageously in proportions of 25:1 to 33.3:1 to phosphoric acid in the Examples which follow. If vacuum has not previously been introduced, the system should be evacuated prior to heating the mixture to a temperature suitable for the action of the chosen bleaching agent and agitating. Following the action of the bleaching agent, the bleached oil should be filtered. To prevent oxidation of the oil, the vacuum should not be broken until the oil has been cooled sufficiently. Alternatively, the oil could be blanketed with an inert gas such as nitrogen or carbon dioxide.

The oil bleached in this manner can then be steam refined/deodorized in a manner known to the art to complete the processing.

The present invention is shown more clearly in the following illustrative examples.

EXAMPLE 1

A high quality corn oil was extracted from corn germ by the process disclosed in Application No. 8012909 filed in Great Britain on Apr. 18, 1980, published on Oct. 28, 1981 as UK Patent Application No. 2,074,183. The same disclosure recently issued as U.S. Pat. No. 4,341,713 claiming priority of the British Application. The corn oil obtained in this manner was uncharacteristically free of phospholipids and waxes, and was refined by the process of this invention and by the alkali refining process of the conventional art for comparison. Certain physical and chemical properties of this crude oil are listed in Table 1.

A six kilogram (6.0 Kg) quantity of the crude corn oil maintained under a vacuum of two millimeters mercury (2mm Hg) absolute pressure at 40° C. was treated with four one-hundredths of a percent (0.04%) by weight phosphoric acid in an eighty-five percent (85%) concentration in aqueous solution and agitated intensely for 15 minutes. Then, one percent (1.0%) bleaching earth by weight of the oil, commercially available from Filtrol Corporation under the Trademark Filtrol 105 TM and two-tenths of a percent (0.2%) filter aid by weight of the oil, available from the Johns-Manville Corporation under the trademark Filtercel TM were added to this evacuated system. The system was heated to 120° C. and intense agitation continued for an additional 20 minutes, after which the mixture was cooled to 80° C. and the vacuum was broken with nitrogen. The bleached oil was filtered off in a Buechner funnel and two portions of two and three-tenths kilogram (2.3 Kg) each were measured out.

The first such portion was designated Sample A and was steam refined-deodorized for 90 minutes at 240° C. under a vacuum of two-tenths of a millimeter mercury (0.2mm Hg) absolute pressure using two percent (2.0%) sparging steam. A small amount of citric acid, known to be a useful additive in alkali refined oils, was added to the second portion, designated Sample B, in a twenty percent (20%) aqueous solution in order to yield a feedstock for deodorization having one hundred parts per million (100 ppm) citric acid. The sample was then steam refined-deodorized under the same conditions as Sample A. Physical and chemical properties of Sample A and B are also shown in Table 1.

Comparative samples were prepared by conventional alkali refining methods in the following manner. A six and one-tenth kilogram (6.1 Kg) quantity of the same crude corn oil maintained at 40° C. was treated with a two and eight-tenths of a percent (2.8%) of 16° Baume sodium hydroxide solution and agitated intensely for 15 minutes. The oil was then heated to 65° C. and stirred for an additional 15 minutes. Following this the oil was centrifuged at fourteen hundred and thirty-three (1433) times the gravitational constant (9.81 m/sec$^2$) at a rate of nine kilograms per hour (9 Kg/hr) to separate the precipatated soaps. All centrifugations in this and the following examples were carried out under these conditions unless specifically noted. The oil was then washed by twice adding and mixing hot distilled water in the amount of ten percent (10%) by weight and centrifuging each time. Subsequently, the oil was dried at a temperature of 100° C. under a vacuum of two millimeters mercury (2 mm Hg) absolute pressure for 30 minutes.

The oil was bleached by adding one percent (1.0%) bleaching earth by weight of the oil, commercially available from Filtrol Corporation under the Trademark Filtrol TM 105, together with two-tenths of a percent (0.2%) filter aid by weight of the oil, commercially available from the Johns-Manville Corporation under the Trademark Filtercel TM, heating the mixture to 120° C. under a vacuum of two millimeters mercury (2 mm·Hg) absolute pressure and agitating for 20 minutes. After cooling to 80° C., the oil was filtered off in a Buechner funnel and two portions of two and three-tenths kilogram (2.3 Kg) each were measured out. Sample C was deodorized for 90 minutes at 240° C. under a vacuum of two-tenths of a millimeter of mercury (0.2 mm Hg) absolute pressure using one and one-half percent (1.5%) sparging steam. A small amount of citric acid was added to Sample D in a twenty percent (20%) aqueous solution in order to yield a feedstock for deodorization having one hundred parts per million (100 ppm) citric acid. The sample was then deodorized under the same conditions as Sample C. Physical and chemical properties of Samples C and D are also given in Table 1.

TABLE 1

| Sample | Free Fatty Acid, % | Color Yellow | Color Red | Phosphorus ppm | Iron ppm | Tocopherols % |
|---|---|---|---|---|---|---|
| Crude Corn Oil | 1.2 | 42 | 9.1 | 0.0 | 1.3 | 0.164 |
| Sample A | 0.015 | 2 | 0.5 | 2.3 | 0.1 | 0.109 |
| Sample B | 0.015 | 2 | 0.5 | 2.8 | 0.1 | 0.083 |
| Sample C | 0.010 | 1 | 0.1 | 1.0 | 0.1 | 0.094 |
| Sample D | 0.010 | 1 | 0.1 | 1.1 | 0.1 | 0.100 |

To assess the stability of the samples produced, the oils were subjected to color reversion and flavor stability tests.

The color reversion test consisted of storage in the dark at ambient temperature with unlimited air headspace for eight week. Color measurements were performed according to AOCS Official Method Cd 13b-45. The color reversion data for each sample are given in Table 2. Since the reversion of color is believed to be a result of oxidative changes in the oil, peroxide values were also measured according to the AOCS Official Method Cd 8-53 at the time of each color determination. This data is also given in Table 2.

TABLE 2

| | Sample A | | | Sample B | | | Sample C | | | Sample D | | |
|---|---|---|---|---|---|---|---|---|---|---|---|---|
| | Color | | Peroxide | Color | | Peroxide | Color | | Peroxide | Color | | Peroxide |
| | Yellow | Red | Value | Yellow | Red | Value | Yellow | Red | Value | Yellow | Red | Value |
| Initially | 2 | 0.5 | | 2 | 0.5 | | 1 | 0.1 | | 1 | 0.1 | |
| 1 Week | 4 | 0.5 | 0.6 | 3 | 0.3 | 0.5 | 2 | 0.2 | 0.9 | 2 | 0.1 | 0.7 |
| 2 Weeks | 3 | 0.4 | 0.6 | 2 | 0.4 | 0.6 | 11 | 1.0 | 1.6 | 4 | 0.7 | 1.0 |
| 3 Weeks | 4 | 0.4 | 1.1 | 4 | 0.4 | 1.2 | 15 | 1.2 | 3.0 | 6 | 0.5 | 1.5 |
| 5 Weeks | 8 | 0.7 | 1.2 | 6 | 0.6 | 0.8 | 18 | 1.4 | 7.5 | 13 | 1.3 | 1.4 |
| 8 Weeks | 12 | 1.1 | 1.3 | 10 | 1.1 | 2.1 | 17 | 1.4 | 31.6 | 15 | 1.2 | 2.3 |

Flavor stability tests were conducted as follows: Samples were stored in the dark at 35° C. with ten percent (10%) air headspace and flavor determinations were made by a trained panel after two (2), five (5) and twelve (12) months. Each sample was scored for flavor strength on a scale from 1 to 9 with 1 being completely flavorless and 9 extremely strong. The results of these tests are given in Table 3.

TABLE 3

| Storage Period | Sample A | Sample B | Sample C | Sample D |
|---|---|---|---|---|
| Initially | 2.0 | 2.1 | 1.9 | 2.1 |
| 2 Months | 2.8 | 2.8 | 4.8* | 3.8 |
| 5 Months | 2.4 | 3.4 | 4.7* | 2.8 |
| 12 Months | 4.6 | 4.3 | Unacceptable* | 5.5 |

*Panel judged flavor significantly stronger with a 99% confidence level.

EXAMPLE 2

Crude, expelled corn oil having appreciable amounts of impurities such as free fatty acids, phospholipids, waxes, trace metals and proteinaceous matter was prepared by the common commercial expelling process. In this process crude oil is recovered by subjecting dry corn germ, typically containing from forty-three percent (43%) to forty-five percent (45%) oil and moisture in the amount of one and one-half percent (1.5%) to two percent (2.0%) by weight, to mechanical pressure in a screw press. Physical and chemical properties for this crude oil are given in Table 4.

A thirteen and one-tenth kilogram (13.1 Kg) quantity of the crude corn oil was mixed with three percent (3.0%) by weight of distilled water and heated to 60° C. The oil was held at this temperature and intensely agitated for 15 minutes. Precipitating gums were separated by centrifugation.

The degummed oil thus obtained was treated with two-tenths of one-percent (0.2%) by weight phosphoric acid in an eighty-five percent (85%) concentration in aqueous solution. The oil was intensely agitated at a temperature of 40° C. for a period of 15 minutes. Then, three percent (3.0%) by weight distilled water was added, the temperature was raised to 60° C. and the mixture was agitated for 15 minutes. The oil was then centrifuged to remove the residual gums and metal complexes.

The first portion of five and two-tenths kilogram (5.2 Kg) of the degummed, demetalized oil was treated with one-tenth of one percent (0.1%) phosphoric acid in an eighty-five percent (85%) concentration in aqueous solution. The oil was then stirred for 15 minutes at 40° C. under a vacuum of two millimeters mercury (2 mm Hg) absolute pressure. The same bleaching earth and filter aid described in Example 1 were then added in the amount of three percent (3.0 ) bleaching earth by weight of the oil and six-tenths of one percent (0.6%) filter aid by weight of the oil. This mixture was heated to 120° C. and agitated for 20 minutes. The oil was cooled to 90° C., the vacuum was broken with nitrogen and the oil was filtered off in a Buechner funnel.

Sample E and Sample F, each containing two and three-tenths kilogram (2.3 Kg) were measured out from the bleached oil obtained in this manner. As in Example 1, citric acid in twenty percent (20%) aqueous solution was added to Sample F to provide one hundred parts per million (100 ppm) citric acid in the feedstock for deodorization. Both samples were then steam refined-deodorized for 90 minutes at 240° C. under a vacuum of two-tenths of a millimeter of mercury (0.2 mm Hg) absolute pressure using two percent (2.0%) sparging steam. Physical and chemical properties for these samples are given in Table 4.

The second portion of six and two-tenths kilogram (6.2 Kg) of the degummed, demetalized oil was reacted with a five and four-tenths of one percent (5.4%) of 16° Baume sodium hydroxide solution and agitated intensely at 40° C. for 15 minutes. The oil was then heated to 65° C. and stirred for 15 minutes. Soapstock produced was separated from the oil by centrifugation. The oil was then washed by twice adding and mixing hot distilled water in the amount of ten percent (10%) by weight and centrifuging each time. Subsequently, the oil was dried at a temperature of 100° C. under a vacuum of two millimeters mercury (2 mm Hg) absolute pressure for 30 minutes.

The oil was bleached by adding two percent (2.0%) bleaching earth by weight of the oil, and four-tenths of one percent (0.4%) of the filter aid, by weight of the oil, used in Example 1. The mixture was heated to 120° C. under a vacuum of two millimeters of mercury (2 mm Hg) absolute pressure and agitated for 20 minutes. The mixture was then cooled to 90° C., the vacuum was broken with nitrogen and the oil was filtered off with a Buechner funnel. Sample G and Sample H each containing two and three-tenths kilogram (2.3 Kg), were measured out from the oil obtained in this manner. As in Example 1, citric acid in a twenty percent (20%) aqueous solution was added to Sample H to provide one hundred parts per million (100 ppm) citric acid in the feedstock for deodorization. Both samples were then deodorized for 90 minutes at 240° C. under a vacuum of two-tenths of a millimeter of mercury (0.2 mm Hg) absolute pressure using two percent (2.0%) sparging steam. Physical and chemical properties for these samples are given in Table 4.

TABLE 4

| Sample | Free Fatty Acid, % | Color Yellow | Color Red | Phosphorus ppm | Iron ppm | Tocopherols % |
|---|---|---|---|---|---|---|
| Crude Corn Oil | 1.8 | | | 440.0 | 1.4 | 0.144 |
| Sample E | 0.020 | 6 | 1.0 | 1.9 | 0.1 | 0.070 |
| Sample F | 0.023 | 6 | 1.0 | 2.3 | 0.1 | 0.096 |
| Sample G | 0.010 | 3 | 0.5 | 1.6 | 0.1 | 0.098 |
| Sample H | 0.010 | 3 | 0.5 | 1.0 | 0.0 | 0.091 |

Following the methods used in Example 1, the samples produced were subjected to color reversion and flavor stability tests. The resulting data are shown in Table 5 and Table 6.

TABLE 5

| | Sample E | | | Sample F | | | Sample G | | | Sample H | | |
|---|---|---|---|---|---|---|---|---|---|---|---|---|
| | Color | | Peroxide | Color | | Peroxide | Color | | Peroxide | Color | | Peroxide |
| | Yellow | Red | Value | Yellow | Red | Value | Yellow | Red | Value | Yellow | Red | Value |
| Initially | 6 | 1.0 | — | 6 | 1.0 | — | 3 | 0.5 | — | 3 | 0.5 | — |
| 1 Week | 8 | 1.0 | 0.9 | 7 | 1.0 | 0.9 | 6 | 0.9 | 0.9 | 4 | 0.4 | 0.5 |
| 2 Weeks | 7 | 0.8 | 0.3 | 7 | 1.2 | 0.4 | 10 | 1.2 | 0.7 | 5 | 0.8 | 0.5 |
| 3 Weeks | 9 | 0.7 | 1.0 | 8 | 1.1 | 0.9 | 15 | 1.2 | 2.1 | 9 | 0.7 | 1.6 |
| 5 Weeks | 13 | 1.0 | 1.3 | 11 | 1.3 | 0.9 | 14 | 1.2 | 12.1 | 12 | 0.8 | 0.6 |

TABLE 5-continued

| | Sample E | | | Sample F | | | Sample G | | | Sample H | | |
|---|---|---|---|---|---|---|---|---|---|---|---|---|
| | Color | | Peroxide | Color | | Peroxide | Color | | Peroxide | Color | | Peroxide |
| | Yellow | Red | Value | Yellow | Red | Value | Yellow | Red | Value | Yellow | Red | Value |
| 8 Weeks | 14 | 1.6 | 1.9 | 11 | 1.2 | 1.1 | 16 | 0.8 | 31.3 | 15 | 1.0 | 3.1 |

TABLE 6

| Storage Period | Sample E | Sample F | Sample G | Sample H |
|---|---|---|---|---|
| Initially | 2.1 | 2.2 | 2.8 | 2.6 |
| 2 Months | 4.4 | 3.2 | 5.7* | 3.7 |
| 5 Months | 3.9 | 4.2 | 5.6* | 4.1 |
| 12 Months | 5.1 | 4.8 | Unacceptable* | 5.0 |

*Panel judged flavor significantly stronger with a 99% confidence level.

EXAMPLE 3

A two thousand two hundred and sixty kilogram (2260 Kg) quantity of regular production crude expelled corn oil was placed into a stainless steel kettle equipped with a two-propeller stirrer. One hundred and thirteen kilograms (113 Kg) water, amounting to five percent (5.0%) by weight, was added to the oil and the mixture was agitated at two hundred and fifty revolutions per minute (250 rpm) at ambient temperature (approximately 27° C.) for 30 minutes. The precipating gums were separated in a Westphalia TM centrifuge operating at sevety-eight hundred revolutions per minute (7800 rpm), with an oil flow rate of four and one-half kilograms per minute (4.5 Kg/minute). The degummed oil obtained was deaerated and dried under a vacuum of eighty millimeters of mercury (80 mm Hg) absolute pressure at a temperature of 40° C. with intense agitation for 70 minutes.

To this oil, two and six one-hundredths kilogram (2.06 Kg) food grade phosphoric acid, amounting to one tenth of one percent (0.1%) by weight, in an eighty-five percent (85%) concentration in aqueous solution was added and the mixture was further agitated under vacuum for another 30 minutes. A two hundred and fifty liter (250 ) portion of the oil was pumped into a slurry kettle where it was mixed with sixty two kilograms (62 Kg), representing three percent (3.0%) by weight of the total oil, bleaching earth (Filtrol TM 105 as described in Example 1) and twelve and one-half kilogram (12.5 Kg), representing six-tenths of a percent (0.6%) by weight of the total oil, filter aid commercially available from the Johns-Manville Corporation under the Trademark Hyflo Super-Cel TM. The mixture in the slurry kettle was agitated intensely for 5 minutes, and was then reintroduced into the original kettle, still under vacuum. The mixture was heated to 120° C. and agitated at one hundred revolutions per minute (100 rpm) for 30 minutes. The mixture was then cooled to 60° C. and held under reduced pressure of one hundred millimeters of mercury (100 mm Hg) absolute pressure until filtration was completed. The filter press was then blown with nitrogen to recover excess oil.

To produce samples which were both citrated and non-citrated, citric acid in the form of a twenty percent (20%) aqueous solution was introduced into a quantity of the oil, designated as Sample J. Citric acid was added into the final deodorization stage at the rate of one milliliter per minute (1 ml/min) representing a proportion of citric acid to the oil of fifty parts per million (50 ppm). The remaining oil was not treated with citric acid and was designated as Sample K.

Both samples were steam refined-deodorized in a continuous pilot plant deodorizer unit at an oil flow rate of two hundred and seventy-four kilograms per hour (274 Kg/hr) at a temperature of 227° C. under a vacuum of one to two millimeters of mercury (1–2 mm Hg) absolute pressure using three percent (3.0%) sparging steam.

Physical and chemical characteristics of the citrated and non-citrated oils are given in Table 7. Color reversion and peroxide value data for the oils obtained in the same manner as described in Example 1 are given in Table 8, and flavor stability data are given in Table 9.

TABLE 7

| | Free Fatty Acid, % | Color Yellow | Color Red | Phosphorus ppm | Iron ppm | Wax ppm | Cold Test hrs. | Total Volatiles (GLC) ppm |
|---|---|---|---|---|---|---|---|---|
| Sample J | 0.028 | 6 | 0.9 | 0.9 | 0.1 | 5.0 | 74 | 2.5 |
| Sample K | 0.034 | 6 | 0.9 | 0.9 | 0.1 | 8.0 | 74 | 4.7 |

TABLE 8

| | Sample J | | | Sample K | | |
|---|---|---|---|---|---|---|
| | Color | | Peroxide | Color | | Peroxide |
| | Yellow | Red | Value | Yellow | Red | Value |
| Initially | 6 | 0.9 | — | 6 | 0.9 | |
| 2 Weeks | 7 | 0.2 | 0.5 | 9 | 0.5 | 0.5 |
| 4 Weeks | 9 | 1.2 | 0.5 | 11 | 1.6 | 0.9 |
| 6 Weeks | 12 | 1.0 | 2.0 | 15 | 1.1 | 3.3 |
| 8 Weeks | 12 | 1.1 | 1.2 | 17 | 1.2 | 2.2 |
| 10 Weeks | 13 | 1.2 | 0.9 | 16 | 2.0 | 1.4 |

TABLE 9

| Storage Period | Sample J | Sample K |
|---|---|---|
| Initially | 4.0 | 4.1 |
| 2 Months | 3.7 | 3.2 |
| 5 Months | 4.5 | 5.1 |
| 8 Months | 5.4 | 5.4 |

EXAMPLE 4

Samples of typical crude soybean oil were refined by the process of this invention and by the alkali refining process of the conventional art for comparison. Certain physical and chemical properties of the oil, at each stage of both refining processes are given in Table 10.

A fourteen kilogram (14 Kg) quantity of crude soybean oil was heated to 40° C. in a glass container, then three percent (3.0%) by weight of distilled water was added and the oil was agitated intensely for 20 minutes. The temperature was raised to 60° C. and a slower agitation continued for another 20 minutes. The oil was then centrifuged to separate the hydrated phosphatides.

The oil thus obtained was treated with two-tenths of a percent (0.2%) phosphoric acid in an eighty-five percent (85%) concentration in aqueous solution and agitated intensely for 15 minutes at a temperature of 40° C. under a nitrogen atmosphere. Distilled water, in the amount of three percent (3.0%) by weight, was then added to the oil. The temperature was increased to 60° C. and a slower agitation continued for another 20 minutes. The oil was then centrifuged under the same conditions as above to separate the oil from residual phosphatides and gums.

A five and three-tenths kilogram (5.3 Kg) portion of the twice degummed oil was treated with three one-hundredths of a percent (0.03%) phosphoric acid in an eighty-five percent (85%) concentration in aqueous solution and stirred at 40° C. under a vacuum of two millimeters of mercury (2 mm Hg) absolute pressure for 15 minutes.

Then, one percent (1.0%) bleaching earth, by weight of the oil, commercially available from Filtrol Corporation under the Trademark Filtrol 105 TM, and two-tenths of a percent (0.2%) filter aid, by weight of the oil, commercially available from the Johns-Manville Corporation under the Trademark Filtercel TM were added and the mixture, while still under vacuum, was heated to 120° C. and intensely agitated. After twenty minutes of such continued treatment, the mixture was cooled to 80° C., the vacuum was broken with nitrogen and the oil was filtered off in a Buechner funnel.

A small amount of citric acid in a fifteen percent (15%) aqueous solution was added to yield one hundred parts per million (100 ppm) citric acid in the bleached oil, and the oil was then steam refined-deodorized for 90 minutes at 240° C. under a vacuum of two-tenths of a millimeter of mercury (0.2 mm Hg) absolute pressure using one and seventenths percent (1.7%) sparging steam. The oil obtained in this manner was designated Sample L.

A comparative sample was prepared by conventional alkali refining methods in the following manner. A six and four-tenths kilogram (6.4 Kg) quantity of the same twice degummed oil maintained at 40° C. was treated with four and fifty-six one-hundreths of a percent (4.56%) of 16° Baume sodium hydroxide solution and was agitated intensely under a nitrogen atmosphere for 15 minutes. The temperature was increased to 65° C. and a slower stirring continued for another 15 minutes. The oil was then centrifuged to separate the precipitated soaps. Following this, the oil was washed by twice adding and mixing hot distilled water in the amount of ten percent (10%) by weight and centrifuging each time. Subsequently, the oil was dried at a temperature of 105° C. under a vacuum of two millimeters of mercury (2 mm Hg) absolute pressure for 30 minutes.

The oil was bleached by adding one percent (1.0%) by weight of the same bleaching earth and two-tenths of a percent (0.2%) by weight of the same filter aid employed above, heating the mixture to 120° C. under a vacuum of two millimeters mercury (2 mm Hg) absolute pressure and agitating for 20 minutes. After cooling to 80° C., the oil was filtered off in a Buechner funnel. A small amount of citric acid in a fifteen percent (15%) aqueous solution was added to yield one hundred parts per million (100 ppm) citric acid in the bleached oil. The oil was then deodorized for 90 minutes at 250° C. under a vacuum of two-tenths of a millimeter of mercury (0.2 mm Hg) absolute pressure using one and one-half percent (1.5%) sparging steam. The oil obtained in this manner was designated Sample M.

TABLE 10

| Processing Stage | Color Yellow | Color Red | Free Fatty Acids, % | Phosphorus ppm | Iron ppm |
|---|---|---|---|---|---|
| Initial Steps | | | | | |
| Crude Oil | 78 | 16.1 | 0.54 | 380.0 | 1.8 |
| Water Degummed Oil | 75 | 10.8 | 0.158 | 53.4 | 0.5 |
| Acid Redegummed Oil | 76 | 10.0 | 0.155 | 20.0 | 0.2 |
| Physical Process | | | | | |
| Bleached Oil | 15 | 1.7 | 0.18 | 2.3 | 0.1 |
| Steam-Refined Deodorized (Sample L) | 1 | 0.3 | 0.015 | 2.3 | 0.1 |
| Alkali Process | | | | | |
| Alkali Treated | 40 | 10.0 | 0.01 | — | — |
| Alkali Treated Bleached | 10 | 1.0 | 0.05 | 0.4 | 0.1 |
| Alkali Treated Deodorized (Sample M) | 1 | 0.1 | 0.010 | 0.4 | 0.1 |

The samples obtained in the above manner were then tested for flavor stability. The samples were sealed in clear eight ounce (8 oz.) glass bottles with ten percent (10%) air headspace, and aged under irradiation and dark storage conditions. The samples subjected to irradiation were stored for three (3) weeks in a light cabinet having a continuous light exposure equivalent to sixty-five (65) foot candles at a constant temperature of 35° C. The samples subjected to dark storage were kept in a light-proof cabinet for six (6) months at a constant temperature of 35° C. Following the method described in Example 1, flavor evaluations on a scale of 1 to 9 were made by a trained panel. The results are reported in Table 11.

TABLE 11

| | Sample L | Sample M |
|---|---|---|
| Initial | 2.3 | 2.6 |
| Light Storage | | |
| 1 Week | 4.6 | 4.8 |
| 2 Weeks | 4.9 | 4.8 |
| 3 Weeks | 5.1 | 5.1 |
| Dark Storage | | |
| 2 Months | 2.7 | 3.6* |
| 4 Months | 3.2 | 3.5 |
| 6 Months | 4.1 | 4.7 |

*Panel judged flavor significantly stronger with a 99% confidence level.

EXAMPLE 5

Commercial Canadian rapeseed oil is produced from rapeseed varieties which are typically low in erucic acid and glucosinolates. This oil is commercially available as a water-degummed crude which contains a maximum of two hundred parts per million (200 ppm) residual phosphorus and no more than five percent (5.0%) erucic acid. As described below, a sample of this oil was refined in the laboratory according to the process of the present invention. An additional sample was prepared by the alkali refining process of the conventional art for comparison. Certain physical and chemical properties of this commercially available oil are listed in Table 12.

A ten kilogram (10 Kg) sample of this Canadian commercial grade crude rapeseed oil was placed in a metal container. With the temperature held constant at 25° C., maleic acid in aqueous solution in the amount of two-hundredths of a percent (0.02%) by weight of the oil was added and the mixture was stirred for ten minutes. Distilled water, in the amount of three percent (3.0%) by weight of the oil, was added and the mixture was agitated for an additional twenty (20) minutes. The mixture was then centrifuged to separate the oil from the hydrated phospholipids.

A three and three-tenths kilogram (3.3 Kg) portion of the rapeseed oil degummed in this manner was bleached according to the further teachings of the present invention. The oil was maintained under a vacuum of two millimeters of mercury (2 mm Hg) absolute pressure at 40° C. and was treated with one-tenth of one percent (0.1%) phosphoric acid by weight of the oil in an eighty-five percent (85%) concentration in aqueous solution and agitated intensely for 10 minutes. Then, three percent (3.0%) bleaching earth, by weight of the oil, commercially available from Filtrol Corporation under the Trademark Filtrol 105 TM, and six-tenths of a percent (0.6%) filter aid, by weight of the oil, commercially available from Johns-Manville Corporation under the Trademark Filtercel TM, were added to this evacuated system. The system was heated to 120° C. with intense agitation. After 20 minutes at this temperature, the mixture was cooled to 80° C., agitation was discontinued and the vacuum was broken with nitrogen. The bleached oil was then filtered off in a Buechner funnel.

A two and four-tenths kilogram (2.4 Kg) portion of the bleached oil thus obtained was then steam refined-deodorized. The bleached oil was first treated with fifty parts per million (50 ppm) citric acid, added in a twenty percent (20%) aqueous solution. Subsequently, the oil was steam refined-deodorized in a five liter (5 l) flask for 90 minutes at 240° C. under a vacuum of two-tenths of a millimeter of mercury (0.2 mm Hg) absolute pressure, using two percent (2.0%) sparging steam. The rapeseed oil physically refined in this manner was designated Sample N. Certain physical and chemical properties of this oil, at various process stages, are shown in Table 12.

A comparative sample was processed by the conventional alkali refining method in the following manner. A five and seven-tenths kilogram quantity (5.7 Kg) of the rapeseed oil degummed with maleic acid as described above was treated with one and three-tenths percent (1.3%) of 14° Baume sodium hydroxide solution and agitated intensely at 25° C. for 15 minutes. Next, the temperature was raised to 65° C. and the oil was stirred slowly for an additional 15 minutes. Afterwards, the precipitating soaps were separated from the oil by centrifugation. The oil was then washed twice by adding and mixing hot water in the amount of ten percent (10%) by weight and separating the water each time by centrifugation. Following this, the oil was dried at a temperature of 60° C. under a vacuum of two millimeters mercury (2 mm Hg) absolute pressure for 15 minutes.

A three and six-tenths kilogram (3.6 Kg) quantity of the oil refined with alkali in this manner was bleached by adding two percent (2.0%) bleaching earth, by weight of the oil, commercially available from the Filtrol Corporation under the Trademark Filtrol TM 105, together with four-tenths of a percent (0.4%) filter aid, by weight of the oil, commercially available from Johns-Manville Corporation under the Trademark Filtercel TM. The mixture was then heated to 120° C. under a vacuum of two millimeters mercury (2 mm Hg) absolute pressure and agitated for 20 minutes. The mixture was then cooled to 80° C., the vacuum was broken with nitrogen and the oil was filtered in a Buechner funnel.

A sample of two and four-tenths kilogram (2.4 Kg) of this oil was measured out and fifty parts per million (50 ppm) citric acid in a twenty percent (20%) aqueous solution was added. The oil was deodorized for 90 minutes at 240° C. under a vacuum of two-tenths of a millimeter of mercury (0.2 mm Hg) absolute pressure using one and five-tenths percent (1.5%) sparging steam. The finished alkali refined oil produced in this manner was designated Sample O. Certain physical and chemical properties of this oil, at various process stages are also shown in Table 12.

TABLE 12

| Processing Stage | Color (1" Cell) Yellow | Red | Free Fatty Acid, % | Phosphorous ppm | Iron ppm |
|---|---|---|---|---|---|
| Initial Steps | | | | | |
| Starting commercial crude oil, | 73 | 5.7 | 0.57 | 163 | 1.6 |
| Oil degummed with maleic acid and water | 36 | 5.8 | 0.49 | 6 | 0.3 |
| Physical Process | | | | | |
| Bleached oil | 7 | 0.5 | 0.50 | 0.0 | 0.0 |
| Steam refined-deodorized oil (Sample N) | 3* | 0.2* | 0.01 | — | 0.0 |
| Alkali Process | | | | | |
| Alkali refined oil | 53 | 4.5 | 0.02 | 5.2 | 0.0 |
| Bleached oil | 9 | 0.8 | 0.10 | 0.9 | 0.0 |
| Deodorized oil (Sample O) | 2* | 0.3* | 0.01 | — | 0.0 |

*Color measured in 5¼ inch cell

To assess the stability of the finished rapeseed oils produced, Samples N and O were subjected to flavor stability tests. The oils were sealed in clear eight ounce (8 oz.) glass bottles with ten percent (10%) air headspace and aged under irradiation and dark storage conditions. The irradiated samples were stored for three (3) weeks in a light cabinet having a continuous light exposure equivalent to sixty five (65) foot candles at a constant temperature of 35° C. The samples subjected to dark storage were kept in a light-proof cabinet for eight (8) weeks at a constant temperature of 30° C. Flavor evaluations were performed by a trained panel. Each sample was scored for flavor strength on a scale from one (1) to nine (9) with one (1) being completely flavorless and nine (9) extremely strong. The results are shown in Table 13.

TABLE 13

| Storage Period | Sample N | Sample O |
|---|---|---|
| Initial | 2.6 | 2.9 |
| Light Storage | | |
| 1 week | 4.6 | 3.9 |
| 2 weeks | 4.6 | 5.2 |
| 3 weeks | 5.1 | 4.9 |
| Dark Storage | | |
| 2 weeks | 2.5 | 2.9 |
| 4 weeks | 3.0 | 3.2 |
| 6 weeks | 2.9 | 3.9* |
| 8 weeks | 3.7 | 3.7 |

*Panel judged flavor significantly stronger with a 99% confidence level

EXAMPLE 6

A sample of commercially available crude peanut oil was divided into two portions, one of which was refined by the process of this invention and the other by conventional alkali refining for comparison. Certain physical and chemical properties of the crude oil and samples obtained at various stages of each refining process are listed in Table 14.

A ten kilogram (10 Kg) sample of crude peanut oil was mixed with two percent (2.0%) distilled water, by weight of the oil, and agitated intensely for 30 minutes at a temperature of 25° C. The oil was then centrifuged to separate the hydrated phospholipids.

Two and eight-tenths kilograms (2.8 Kg) of the peanut oil degummed in this manner was treated with two-hundredths of a percent (0.02%) phosphoric acid, by weight of the oil, in an eighty-five percent (85%) concentration in aqueous solution and agitated intensely for 15 minutes at a temperature of 40° C. under atmospheric pressure. Then, five-tenths of a percent (0.5%) Filtrol 105 TM bleaching earth, by weight of the oil, and one-tenth of a percent (0.1%) Filtercel TM filter aid, by weight of the oil, both described in previous examples, were added and the mixture was agitated under a vacuum of two millimeters of mercury (2 mm Hg) absolute pressure while the temperature was raised to 110° C. After 20 minutes of intense agitation under these conditions the mixture was cooled to 90° C., the vacuum was broken with nitrogen and the oil was filtered off in a Buechner funnel.

A two and four-tenths kilogram (2.4 Kg) sample of the bleached oil was treated with thirty parts per million (30 ppm) citric acid in a twenty percent (20%) aqueous solution and the oil was then steam refined-deodorized for 90 minutes at 240° C. under a vacuum of two-tenths of a millimeter of mercury (0.2 mm Hg) absolute pressure using two percent (2.0%) sparging steam. The oil obtained in this manner was designated Sample P.

A comparative sample was prepared by the conventional alkali refining method in the following manner. A two and eight-tenths kilogram (2.8 Kg) quantity of oil which had previously been degummed with water was treated with one and two-tenths of a percent (1.2%) 14° Baume sodium hydroxide solution, by weight of the oil, and agitated intensely at 25° C. for 15 minutes. The temperature was then raised to 65° C. and the oil was stirred slowly for an additional 15 minutes. The oil was centrifuged to separate the precipitated soaps. This was followed by twice washing the oil with hot distilled water in the amount of ten percent (10%) by weight and centrifuging each time. Finally, the oil was dried at a temperature of 60° C. under a vacuum of two millimeters of mercury (2 mm Hg) absolute pressure for 15 minutes.

Bleaching of the oil was performed by adding five-tenths of a percent (0.5%) of Filtrol 105 TM bleaching earth together with one-tenth of a percent (0.1%) of Filtercel TM type filter aid, heating the mixture to 110° C. under a vacuum of two millimeters mercury (2 mm Hg) absolute pressure and agitating for 20 minutes. After cooling the mixture to 90° C., the vacuum was broken with nitrogen and the oil was filtered in a Buechner funnel.

A two and four-tenths kilogram (2.4 Kg) sample of the bleached oil was treated with thirty parts per million (30 ppm) citric acid in a twenty percent (20%) aqueous solution, and deodorized for 60 minutes at 240° C. under a vacuum of two-tenths of a millimeter of mercury (0.2 mm Hg) absolute pressure using one and one-half percent (1.5%) sparging steam. The oil obtained in this manner was designated Sample R.

TABLE 14

| Processing Stage | Color (5¼" Cell) Yellow | Color (5¼" Cell) Red | Free Fatty Acid, % | Phosphorus ppm | Iron ppm |
|---|---|---|---|---|---|
| Initial Step | | | | | |
| Starting crude oil | 50 | 3.5 | 0.35 | 246 | 0.5 |
| Water degummed oil | 50 | 3.5 | 0.08 | — | — |
| Physical Process | | | | | |
| Bleached oil | 2.9 | 0.5 | 0.063 | 2 | 0.0 |
| Steam Refined-Deodorized oil (Sample P) | 0.7 | 0.2 | 0.017 | 2 | — |
| Alkali Process | | | | | |
| Bleached oil | 0.8 | 0.1 | 0.015 | 0.3 | 0.0 |
| Deodorized oil (Sample R) | 0.7 | 0.1 | 0.010 | 0 | — |

Both samples were tested for color reversion and development of peroxides. The color reversion test consisted of storage in the dark at 25° C. with unlimited air headspace for 6 weeks. Color and peroxide measurements were performed according to AOCS Official Methods, Cd 13b-45 and Cd 8-53 respectively. The results are given in Table 15.

TABLE 15

| | Sample P | | | Sample R | | |
|---|---|---|---|---|---|---|
| | Color | | Peroxide | Color | | Peroxide |
| | Yellow | Red | Value | Yellow | Red | Value |
| Initially | 0.1 | 0.2 | 0.0 | 0.7 | 0.1 | 0.0 |
| 2 Weeks | 1.3 | 0.3 | 0.7 | 2.1 | 0.5 | 1.5 |
| 4 Weeks | 1.9 | 0.4 | 1.0 | 2.5 | 0.6 | 4.0 |
| 6 Weeks | 2.8 | 0.8 | 0.8 | 3.1 | 0.8 | 7.8 |

EXAMPLE 7

Crude, "non-break" safflower oil, which is available commercially, typically has already been degummed with water. The residual level of phospholipids in such oil is sufficiently low that the oil may be refined by the process of the present invention without any additional pretreatment. Certain physical and chemical characteristics of this crude safflower oil and samples obtained at various stages of each refining process are listed in Table 16. A sample of such commercially available oil was divided into two portions, one of which was refined by the process of this invention and the other by conventional alkali refining for comparison.

A three kilogram (3 Kg) sample of crude safflower oil was treated with eight one-hundredths of a percent (0.08%) phosphoric acid in an eighty-five percent (85%) concentration in aqueous solution and stirred at 25° C. under air for 10 minutes. Then, two percent (2.0%) Filtrol 105 TM bleaching earth, by weight of the oil, and four-tenths of a percent (0.4%) Filtercel TM filter aid, by weight of the oil, both described previously, were added and the mixture was heated to 110° C. with intense agitation under a vacuum of two millimeters of mercury (2 mm Hg) absolute pressure. After 20 minutes of such treatment, the mixture was cooled to 80° C., the vacuum was broken with nitrogen and the oil was filtered in a Buechner funnel.

A sample of two and four-tenths kilogram (2.4 Kg) of the bleached oil was measured out and treated with thirty parts per million (30 ppm) of citric acid in a twenty percent (20%) aqueous solution. Following this, the oil was steam refined-deodorized for 90 minutes at 240° C. under a vacuum of two-tenths of a millimeter of mercury (0.2 mm Hg) absolute pressure using two percent (2.0%) sparging steam. The oil obtained in this manner was designated Sample S.

A comparative sample was prepared by the conventional alkali refining method in the following manner. A four and seven-tenths kilogram (4.7 Kg) quantity of crude safflower oil was treated with four percent (4.0%) of 14° Baume sodium hydroxide solution and was agitated intensely at 25° C. for 15 minutes. Then, the temperature was increased to 65° C. and a slower stirring was continued for another 15 minutes. The oil was then centrifuged to remove soaps. This was followed by twice washing the oil with hot distilled water in the amount of ten percent (10%) by weight and centrifuging each time. After the second washing, the oil was dried for 15 minutes at a temperature of 60° C. under a vacuum of two millimeters of mercury (2 mm Hg) absolute pressure.

Bleaching of the oil was performed by adding one and one-half percent (1.5%) Filtrol 105 TM bleaching earth, by weight of the oil, and three-tenths of a percent (0.3%) Filtercel TM filter aid, by weight of the oil, and heating the mixture to 110° C. under a vacuum of 20 minutes. After cooling the mixture to 80° C., the vacuum was broken with nitrogen and the oil was filtered in a Buechner funnel.

A small amount of citric acid in a twenty percent (20%) aqueous solution was added to yield thirty parts per million (30 ppm) citric acid in the bleached oil. Next, a two and four-tenths kilogram (2.4 Kg) sample of the oil was deodorized for 60 minutes at 240° C. under a vacuum of two-tenths of a millimeter of mercury (0.2 mm Hg) absolute pressure using one and one-half percent (1.5%) sparging steam. The oil obtained in this manner was designated Sample T.

TABLE 16

| Processing Stage | Color (5¼" Cell) Yellow | Red | Free Fatty Acid, % | Phosphorus ppm | Iron ppm |
|---|---|---|---|---|---|
| Crude, "non-break" commercial Safflower oil | 35 | 4.1 | 0.30 | 53 | 0.1 |
| Physical Process | | | | | |
| Bleached oil | 4.1 | 0.6 | 0.29 | 3.0 | 0.1 |
| Steam Refined-Deodorized oil (Sample S) | 1.9 | 0.2 | 0.015 | 3.0 | — |
| Alkali Process | | | | | |
| Alkali Refined and Bleached oil | 2.2 | 0.3 | 0.022 | 1.0 | 0.2 |
| Deodorized oil (Sample T) | 0.9 | 0.1 | 0.010 | 1.0 | — |

Both samples were then subjected to color reversion test and peroxides measurements by the methods previously described. The results are listed in Table 17.

TABLE 17

| | Sample S | | | Sample T | | |
|---|---|---|---|---|---|---|
| | Color | | Peroxide | Color | | Peroxide |
| | Yellow | Red | Value | Yellow | Red | Value |
| Initially | 1.9 | 0.2 | 0.0 | 0.9 | 0.1 | 0.0 |
| 2 Weeks | 2.4 | 0.4 | 2.4 | 1.3 | 0.2 | 2.4 |
| 4 Weeks | 2.4 | 0.4 | 7.6 | 1.9 | 0.2 | 7.8 |
| 6 Weeks | 2.2 | 0.3 | 18.0 | 1.7 | 0.2 | 17.8 |
| 8 Weeks | 2.0 | 0.3 | 25.8 | 1.6 | 0.2 | 25.9 |

Other features, advantages and specific embodiments of this invention will become readily apparent to those exercising ordinary skill in the art after reading the foregoing disclosures. These specific embodiments are within the scope of the claimed subject matter unless otherwise expressly indicated to the contrary. Moreover, while specific embodiments of this invention have been described in considerable detail, variations and modifications of these embodiments can be effected without departing from the spirit and scope of this invention as disclosed and claimed.

What is claimed is:

1. A process for the refining of crude vegetable oils to provide a product having good oxidative, flavor and cold-test stabilities, comprising the steps of:
   (a) degumming the crude oil by
      (i) combining said crude oil with a small quantity of water to form a mixture,
      (ii) agitating said mixture, and
      (iii) separating the oil from the water and precipitating impurities;
   (b) degumming/demetalizing the degummed oil obtained in step (a)(iii) by
      (i) combining said oil with a small amount of a degumming/demetalizing reagent to form a mixture,
      (ii) agitating said mixture,
      (iii) combining the mixture with a small amount of water,
      (iv) agitating the mixture, and
      (v) separating the oil from the residual impurities;
   (c) bleaching the degummed/demetalized oil obtained in step (b)(v) by
      (i) combining said oil with an amount of phosphoric acid in aqueous solution so as to form a mixture with at least two one-hundredths of a percent phosphoric acid by weight,
      (ii) maintaining the mixture at a suitable temperature while agitating intensely to allow reaction,
      (iii) combining the mixture thus treated in step (c)(ii) with a bleaching agent in proportions of 25:1 to 33.3:1 to said phosphoric acid to allow in the final product a level of up to three parts per million residual phosphorus derived from the phosphoric acid added in step (c)(i),
      (iv) raising the temperature of the mixture of step (c)(iii) under vacuum to an effective temperature for the action of the bleaching agent and maintaining said temperature while agitating said mixture,
      (v) cooling the mixture of step (c)(iv) to a temperature at which the vacuum can be broken, and
      (vi) filtering the bleached oil; then
   (d) steam refining-deodorizing the bleached oil obtained in step (c)(vi).

2. A process for the refining of crude vegetable oils to provide a product having good oxidative, flavor and cold-test stabilities, comprising the steps of:
   (a) degumming the crude oil by
      (i) combining said crude oil with a small quantity of water to form a mixture with said oil,
      (ii) agitating said mixture,
      (iii) separating the oil from the water and precipitating impurities,
   (b) bleaching the oil obtained in step (a)(iii) by
      (i) combining said oil with an amount of phosphoric acid in aqueous solution so as to form a mixture with at least two one-hundredths of a percent phosphoric acid by weight, (ii) maintaining the mixture at a suitable temperature while agitating intensely to allow reaction, (iii) combining the mixture thus treated in step (b)(ii) with a bleaching agent in proportions of 25:1 to 33.3:1 to said phosphoric acid to allow in the final product a level of up to three parts per million residual phosphorus derived from the phosphoric acid added in step (b)(i), (iv) raising the temperature of the mixture of step (b)(iii) under vacuum to an effective temperature for the action of the bleaching agent and maintaining said temperature while agitating said mixture, (v) cooling the mixture of step (b)(iv) to a temperature at which the vacuum can be broken, and (vi) filtering the bleached oil; then (c) steam refining-deodorizing the bleached oil obtained in step (b)(vi).

3. A process for the refining of crude vegetable oils to provide a product having good oxidative, flavor and cold-test stabilities, comprising the steps of:

(a) degumming/demetalizing the crude oil by (i) combining said oil with a small amount of a degumming/demetalizing reagent to form a mixture, (ii) agitating the mixture, (iii) combining the mixture with a small amount of water, (iv) agitating the mixture, (v) separating the oil from the water and precipitating impurities;

(b) bleaching the oil obtained in step (a)(v) by (i) combining said oil with an amount of phosphoric acid in aqueous solution so as to form a mixture with at least two one-hundredths of a percent phosphoric acid by weight, (ii) maintaining the mixture at a suitable temperature while agitating intensely to allow reaction, (iii) combining the mixture thus treated in step (c)(ii) with a bleaching agent in proportions of 25:1 to 33.3:1 to said phosphoric acid to allow in the final product a level of up to three parts per million residual phosphorus derived from the phosphoric acid added in step (b)(i), (iv) raising the temperature of the mixture of step (b)(iii) under vacuum to an effective temperature for the action of the bleaching agent and maintaining said temperature while agitating said mixture, (v) cooling the mixture of step (b)(iv) to a temperature at which the vacuum can be broken, and (vi) filtering the bleached oil; then (c) steam refining-deodorizing the bleached oil obtained in step (b)(vi).

4. A process for the refining of crude vegetable oils to provide a product having good oxidative, flavor and cold-test stabilities, comprising the steps of:

(a) bleaching the crude oil by (i) combining said oil with an amount of phosphoric acid in aqueous solution so as to form a mixture with at least two one-hundredths of a percent phosphoric acid by weight, (ii) maintaining the mixture at a suitable temperature while agitating intensely to allow reaction, (iii) combining the mixture thus treated in step (c)(ii) with a bleaching agent in proportions of 25:1 to 33.3:1 to said phosphoric acid to allow in the final product a level of up to three parts per million residual phosphorus derived from the phosphoric acid added in step (a)(i), (iv) raising the temperature of the mixture of step (a)(iii) under vacuum to an effective temperature for the action of the bleaching agent and maintaining said temperature while agitating said mixture, (v) cooling the mixture of step (a)(iv) to a temperature at which the vacuum can be broken, and (vi) filtering the bleached oil; then (b) steam refining-deodorizing the bleached oil obtained in step (a)(vi).

5. The process of claim 1,2 or 3 in which step (a) is carried out at a temperature between 5° C. and 20° C.

6. The process of claim 1,2,3 or 4 in which the bleaching step is carried out at a temperature between 90° C. and 120° C.

7. The process of claim 1,2,3 or 4 in which the amount of phosphoric acid added in the bleaching step is sufficient to form a mixture with from two one-hundredths of a percent to two tenths of a percent (0.2%) phosphoric acid by weight.

8. The process of claim 1,2,3 or 4 in which the amount of phosphoric acid added in the bleaching step is sufficient to form a mixture with from three one-hundredths of a percent (0.03%) to one tenth of a percent (0.1%) phosphoric acid by weight.

9. An oil having good oxidative, flavor and cold-test stabilities, produced by the process of claim 1.

10. An oil having good oxidative, flavor and cold-test stabilities, produced by the process of claim 2.

11. An oil having good oxidative, flavor and cold-test stabilities, produced by the process of claim 3.

12. An oil having good oxidative, flavor and cold-test stabilities, produced by the process of claim 4.

* * * * *